US008491415B2

(12) United States Patent
Ishikawa et al.

(10) Patent No.: US 8,491,415 B2
(45) Date of Patent: Jul. 23, 2013

(54) PUTTER HEAD

(75) Inventors: Tatsuya Ishikawa, Chichibu (JP); Wataru Ban, Chichibu (JP); Fumiaki Sato, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 528 days.

(21) Appl. No.: 12/392,496

(22) Filed: Feb. 25, 2009

(65) Prior Publication Data

US 2010/0035703 A1 Feb. 11, 2010

(51) Int. Cl.
*A63B 53/04* (2006.01)

(52) U.S. Cl.
USPC ..... 473/340

(58) Field of Classification Search
USPC ..... 473/340
See application file for complete search history.

(56) References Cited

U.S. PATENT DOCUMENTS

| | | | | |
|---|---|---|---|---|
| 5,358,249 | A * | 10/1994 | Mendralla | 473/331 |
| 6,231,458 | B1 * | 5/2001 | Cameron et al. | 473/332 |
| 2006/0154739 | A1 * | 7/2006 | Mann et al. | 473/330 |
| 2007/0099724 | A1 * | 5/2007 | Tateno | 473/340 |

FOREIGN PATENT DOCUMENTS

| | | | |
|---|---|---|---|
| JP | 6-77767 | U | 11/1994 |
| JP | 2007-117472 | A | 5/2007 |
| JP | 2007-117634 | A | 5/2007 |
| JP | 2008-154974 | A | 7/2008 |

OTHER PUBLICATIONS

Japanese Office Action issued in Japanese Patent Application No. 2008-247820 dated Aug. 21, 2012 English translation.

* cited by examiner

*Primary Examiner* — Michael Dennis
(74) *Attorney, Agent, or Firm* — Sughrue Mion, PLLC

(57) ABSTRACT

A putter head prevents a ball from sliding over a green while maintaining golfers' preferred hitting feel and roll of the ball. A face insert fitted in a face of the putter head has an outer layer which serves as a ball-hitting surface and an inner layer which is located on an inner side of a head body. A smash factor of a second polymer material forming the inner layer is greater than a smash factor of a first polymer material forming the outer layer. Two types of groove, grooves of a first groove group and grooves of a second groove group are formed in an external surface of the outer layer. The grooves of the first groove group may be 0.25 to 1.6 mm wide and 0.05 to 0.5 mm deep and the grooves of the second groove group may be 0.075 to 0.5 mm wide and 0.025 to 0.1 mm deep.

8 Claims, 7 Drawing Sheets

PUTTER HEAD

BACKGROUND OF THE INVENTION

The present invention relates to a putter head.

A putter head has been proposed in which a face of a head body is fitted with a face insert made of a material, that is different from that of the head body. For example, Japanese Patent Application Publication No. 2007-117472 describes a putter head in which a face of a head body is fitted with a face insert which has a two-layer structure made up of a high-hardness layer and low-hardness layer. As examples of face insert materials, the patent document cites synthetic resins such as ionomer resins and polyurethane resins, thermoplastic elastomers such as polyurethane elastomers and polyester elastomers, and rubbers such as styrene-butadiene rubber and butadiene rubber.

Also, Japanese Patent Application Publication No. 2007-117634 describes a putter head fitted with a face insert which has a two-layer structure made up of a high-hardness layer and a low-hardness layer, wherein in a central area of the face insert, a projection is formed on the high-hardness layer and a depression is formed in the low-hardness layer such that the projection will be buried in the depression.

Normally, putter heads are fitted with a face insert made of a polymer in order to provide a soft feel of hitting a ball. Normally, the lower the hardness of the polymer used, the softer the hitting feel. However, the roll of the ball, which is related to the smash factor, varies with the polymer used. For example, in the case of thermoplastic polyurethane elastomers, since higher hardness normally tends to result in a higher smash factor, the use of a low-hardness thermoplastic polyurethane elastomer to obtain a soft hitting feel will result in a low smash factor. Consequently, it is difficult to provide an appropriate putter for a golfer who prefers a soft hitting feel, but wants a putter with a high smash factor. Conversely, it is also difficult to provide an appropriate putter to a golfer who prefers a hard hitting feel, but wants a putter with a low smash factor.

On the other hand, putter heads generally have a loft angle of approximately 2 to 5 degrees, and it has been found by means of high-speed photography that backspin is imparted to a golf ball upon impact. The backspin causes the ball to slide over a green for a while, and then changes to overspin, causing the ball to roll over the green. A large amount of backspin decreases stability of a putt. A putter head which reduces backspin is described in Japanese Patent Application Publication No. 2008-154974. The putter head has plural grooves formed substantially in parallel in its face surface. A ratio W/S between groove width W (mm) and groove-to-groove spacing S (mm) is 0.5 to 2.0.

The parallel grooves formed in the face surface reduce the amount of backspin of the putted ball, causing the ball rolling over the green to go into overspin at an early stage after the putt. Consequently the ball rolls smoothly along the line aimed at. However, the formation of plural grooves in the surface of the face greatly reduces the contact area of the surface with the ball, changing the hitting feel and reducing initial ball speed and thus the smash factor. On the other hand, a high smash factor increases the initial ball speed, making the ball liable to slide over the green. The sliding of the ball over the green dampens the force of the ball, often causing a putt to come up short.

SUMMARY OF THE INVENTION

In view of the above problems, an object of the present invention is to provide a putter head capable of offering golfers' preferred hitting feel and roll of a ball at the same time.

Another object of the present invention is to provide a putter head which can prevent the ball from sliding over a green while maintaining golfers' preferred hitting feel and roll of the ball.

To achieve the above objects, according to the present invention, there is provided a putter head comprising a head body having a face which has a recess formed in a central area of the face; and a face insert fitted in the recess, the face insert having a multilayer structure made up of an outer layer serving as a ball-hitting surface and an inner layer located on an inner side of the head body, wherein a second smash factor of a second polymer material forming the inner layer is larger than a first smash factor of a first polymer material forming the outer layer. Preferably a first hardness of the first polymer material forming the outer layer is set lower than a second hardness of the second polymer material forming the inner layer although the first hardness of the first polymer material forming the outer layer may be set either higher or lower than the second hardness of the second polymer material forming the inner layer.

According to another aspect of the present invention, there is provided a putter head comprising a head body having a face which has a recess formed in a central area of the face; and a face insert fitted in the recess the face insert having a multilayer structure made up of an outer layer serving as a ball-hitting surface and an inner layer located on an inner side of a head body, and a second hardness of a second polymer material forming the inner layer is higher than a first hardness of a first polymer material forming the outer layer, and wherein a second smash factor of the second polymer material is smaller than a first smash factor of the first polymer material forming the outer layer.

In the putter head according to the present invention, preferably each of the inner layer and the outer layer has a uniform thickness at least in a central area of the face insert. Also, preferably, a protrusion is formed on an internal surface of the outer layer and a groove or hole is formed in an external surface of the inner layer to fit over the protrusion; and the outer layer and the inner layer are joined together by a fit between the protrusion and the groove or hole.

In the putter head, a groove group made up of a plurality of parallel grooves may be formed in an external surface of the outer layer, the groove group including a first groove group and a second groove group of different types, wherein the grooves of the first groove group are approximately 0.25 to 1.6 mm wide and approximately 0.05 to 0.5 mm deep and the grooves of the second groove group are approximately 0.075 to 0.5 mm wide and approximately 0.025 to 0.1 mm deep, the first groove group may have a groove spacing of 0.5 to 2.0 mm, and the grooves of the second groove group may be placed between the grooves of the first groove group. Formation of such groove groups is also applicable to a multilayer structure in which hardness of the second polymer material forming the inner layer is lower than hardness of the first polymer material forming the outer layer; and the second smash factor of the second polymer material is smaller than the first smash factor of the first polymer material.

In the putter head, preferably an angle formed between a face surface of the face insert and sides of the grooves of the second groove group is larger than an angle formed between the face surface of the face insert and sides of the grooves of the first groove group. Also, in the putter head according to the present invention, preferably an intersection angle between the face surface of the face insert and sides of the grooves of the first groove group is unequal to an intersection angle between the face surface of the face insert and sides of the grooves of the second groove group.

According to the present invention, when the face insert has a multilayer structure made up of at least an outer layer and an inner layer, since a hitting feel experienced by a golfer is affected greatly by D hardness of the first polymer material forming the outer layer which comes into direct contact with a golf ball while the smash factor of the two-layer structure depends on both smash factor of the first polymer material of the outer layer and smash factor of the second polymer material of the inner layer, by setting the smash factor of the second polymer material of the inner layer larger than the smash factor of the first polymer material of the outer layer, it is possible to improve the smash factor, which is related to the roll of the ball, while maintaining the hitting feel provided by the first polymer material of the outer layer.

Also, with polymers such as polyurethane, higher hardness generally tends to result in a higher smash factor as described above, and by using different types of polymer, it is possible to make the hardness of the second polymer material forming the inner layer higher than the hardness of the first polymer material forming the outer layer and make the second smash factor of the second polymer material smaller than the first smash factor of the first polymer material. This makes it possible to reduce the smash factor, i.e., roll of the ball while maintaining the hard hitting feel provided by the first polymer material of the outer layer.

The roll of the ball can be evaluated in terms of the smash factor with which the golf ball is hit by the putter. The smash factor is a ratio of initial ball speed to head speed of the putter when the golf ball is hit by the putter. Thus, the larger the smash factor, the better the ball rolls for the same head speed.

According to the present invention, since a groove group, which includes a first groove group and a second groove group of different types, is formed in the external surface of the outer layer of the face insert, with the grooves of the first groove group being approximately 0.25 to 1.6 mm wide and approximately 0.05 to 0.5 mm deep and the grooves of the second groove group being approximately 0.075 to 0.5 mm wide and approximately 0.025 to 0.1 mm deep, the first groove group having a groove spacing of 0.5 to 2.0 mm, and at least one groove of the second groove group being placed between each pair of adjacent grooves of the first groove group, it is possible to prevent a substantial decrease in the contact area between the ball and face surface, maintain the hitting feel and initial ball speed, and decrease any backspin imparted to the ball. Also, the wide grooves of the first groove group are formed at predetermined intervals, when the ball is putted in such a way that a forward spin will be imparted to the ball, the ball is hooked by the grooves of the first groove group, increasing the amount of forward spin. In this way, since overspin is applied to the ball initially upon putting regardless of the way the ball is hit, it is possible to prevent the ball from sliding over the green. The grooves of the first groove group may be approximately 0.5 to 1.52 mm wide and approximately 0.25 to 0.5 mm deep. The grooves of the second groove group may be approximately 0.1 to 0.5 mm wide and approximately 0.05 to 0.1 mm deep. The first groove group may have a groove spacing of 0.8 to 1.5 mm.

DESCRIPTION OF THE PREFERRED EMBODIMENTS

A putter head according to an embodiment of the present invention will be described below with reference to the accompanying drawings. However, it should be noted that the present invention is not limited to the embodiment described below.

Figure 1:
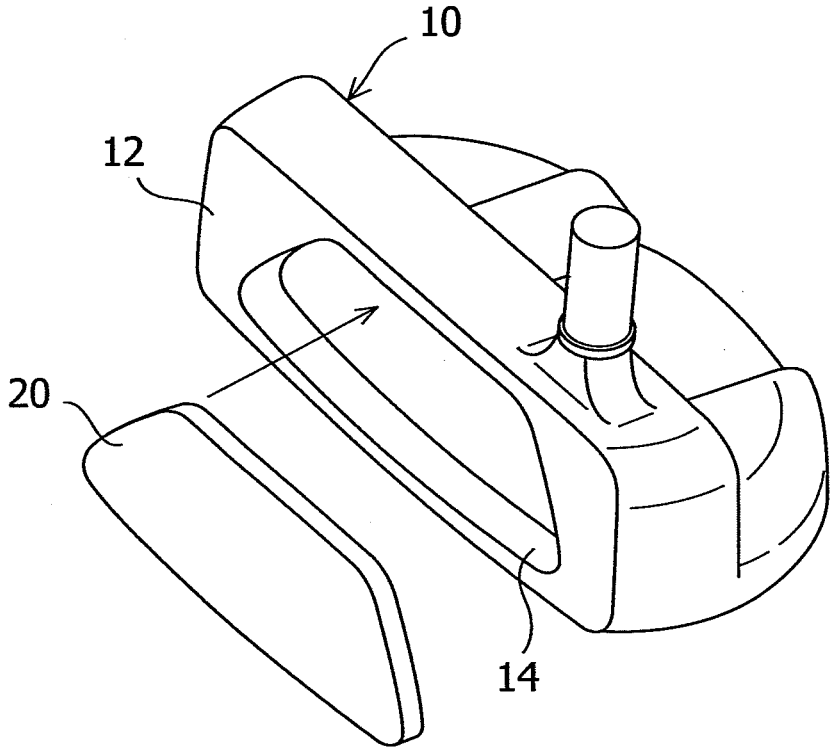
FIG. 1 is an exploded perspective view showing a putter head according to an embodiment of the present invention.

As shown in FIG. 1, the putter head 10 according to the present embodiment mainly includes a head body 12 made of metal and face insert 20 made of polymer. A face of the head body 12 has a recess 14 formed in its central area. When the face insert 20 is fitted in the recess 14, a surface of the face insert 20 becomes part of a face surface of the putter head 10.

Figure 2:
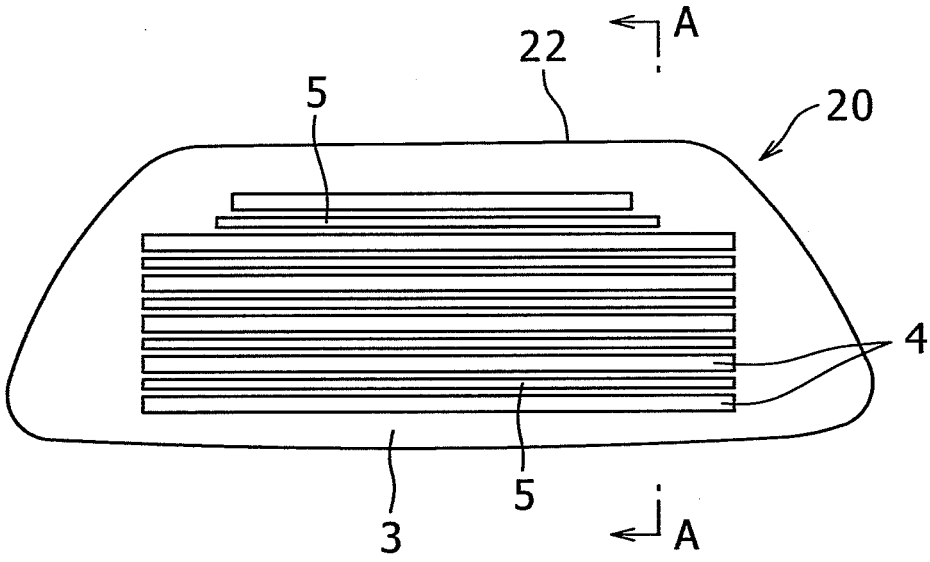
FIG. 2 is a front view showing a front side of a face insert shown in FIG. 1.
Figure 5B:
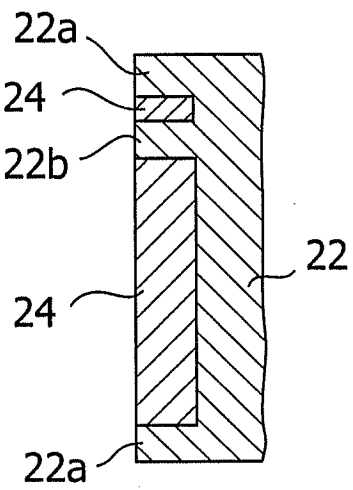
FIG. 5B is a sectional view of the face insert on the rear side, taken along line B-B.
Figure 5A:
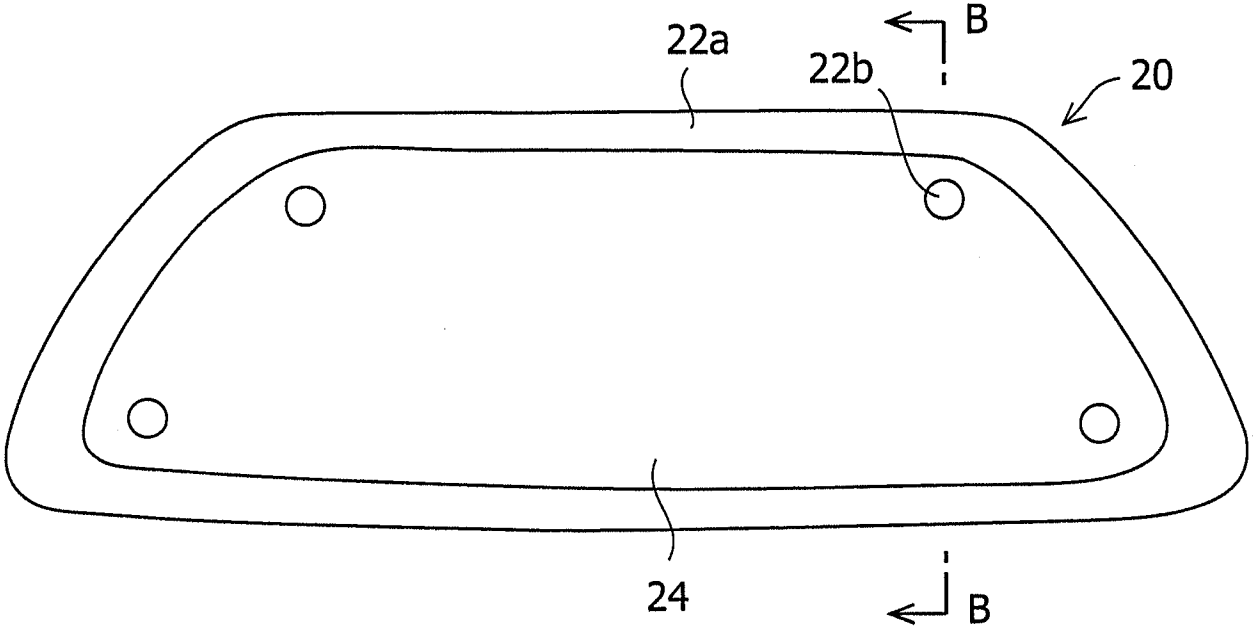
FIG. 5A is a diagram showing a rear side of the face insert shown in FIG. 2

Multiple parallel grooves 4 and 5 may be formed in the surface of the face insert 20 as shown in FIG. 2. Also, as shown in FIG. 5, the face insert 20 has a two-layer structure made up of an outer layer 22 which comes into direct contact with a golf ball and an inner layer 24 located on an inner side of the head body 12 and joined with the outer layer 22. Thus, the grooves 4 and 5 are formed in an external surface of the outer layer 22 of the face insert 20, i.e., in the face surface.

Different types of polymer are used for the outer layer 22 and inner layer 24. A first polymer used for the outer layer 22 and second polymer used for the inner layer 24 can be selected from synthetic resins, thermoplastic elastomers, and rubbers.

Examples of synthetic resins available for use include ionomer resins and polyurethane resins. Examples of thermoplastic elastomers available for use include thermoplastic polyurethane elastomers, thermoplastic polyamide elastomers, and thermoplastic polyester elastomers. Examples of rubbers available for use include styrene-butadiene rubbers and butadiene rubbers.

Preferably the first polymer used for the outer layer 22 is compliant with JIS K6253 and has a type D durometer hardness (hereinafter referred to as "D hardness") of approximately 65 or below. When a golfer hits a ball, since a hitting feel depends greatly on the D hardness of the outer layer 22, if the D hardness of the outer layer 22 is approximately 65 or below, the golfer will have a soft hitting feel different from that of metal. Although the hitting feel varies from golfer to golfer, generally a D hardness in a range of approximately 35 to 45 gives a very soft hitting feel, and a D hardness in a range of approximately 55 to 65 gives a relatively hard hitting feel. On the other hand, the lower limit of the D hardness is set to approximately 33 by rules.

The second polymer used for the inner layer 24 can have a smash factor greater than or less than that of the first polymer of the outer layer 22. When the smash factor of the second polymer is greater than the smash factor of the first polymer, the smash factor of the putter head 10 is increased. On the other hand, when the smash factor of the second polymer is less than the smash factor of the first polymer, the smash factor of the putter head 10 is decreased. The hitting feel of the putter head 10 depends heavily on the D hardness of the first polymer of the outer layer 22 of the face insert 20, but the smash factor of the putter head 10 depends on both the first polymer of the outer layer 22 and second polymer of the inner layer 24. When the second polymer of the inner layer 24 can have a smash factor either greater than or less than that of the first polymer of the outer layer 22, it is possible to produce a putter head 10 which suits each golfer's taste in terms of both hitting feel and smash factor.

With a preferable combination of the first polymer of the outer layer 22 and second polymer of the inner layer 24, the D hardness of the first polymer is in a high range of approximately 55 to 65, the D hardness of the second polymer is lower than the D hardness of the first polymer, and the smash factor of the second polymer is greater than the smash factor of the first polymer. Preferably, differences in the smash factor are approximately at least 0.005, more preferably approximately at least 0.010, and still more preferably approximately at least 0.020.

With another preferable combination, the D hardness of the first polymer is in a low range of approximately 33 to 50, the D hardness of the second polymer is higher than the D hardness of the first polymer, and the smash factor of the second polymer is greater than the smash factor of the first polymer. Preferably the difference in the smash factor is approximately at least 0.005, more preferably approximately at least 0.010, and still more preferably approximately at least 0.020.

With still another preferable combination, the D hardness of the first polymer is in a low range of approximately 33 to 50, the D hardness of the second polymer is higher than the D hardness of the first polymer, and the smash factor of the second polymer is smaller than the smash factor of the first polymer. Preferably the difference in the smash factor is approximately 0.005 or more, more preferably approximately 0.010 or more, and still more preferably approximately 0.020 or more. Although there is no particular upper limit to the smash factor difference, in the case of existing materials, the difference will not exceed approximately 0.1.

With yet another preferable combination, the D hardness of the first polymer is in a high range of approximately 55 to 65, the D hardness of the second polymer is lower than the D hardness of the first polymer, and the smash factor of the second polymer is less than the smash factor of the first polymer. Preferably the difference in the smash factor is approximately at least 0.005, more preferably approximately at least 0.010, and still more preferably approximately at least 0.020.

Preferably, the thickness of the outer layer 22 is approximately at least 0.25 mm, and more preferably approximately at least 0.5 mm. Preferably the thickness of the outer layer 22 is approximately not more than 3 mm, and more preferably approximately not more than 2 mm. A thickness of the outer layer 22 that is less than approximately 0.25 mm will lessen the effect which the D hardness of the outer layer 22 has on the hitting feel of the putter head. On the other hand, a thickness of the outer layer 22 greater than approximately 3 mm will lessen the effect which the smash factor of the inner layer 24 has on the smash factor of the putter head.

Preferably, the thickness of the inner layer 24 is approximately at least 0.75 mm, and more preferably approximately at least 1.0 mm. Preferably, the thickness of the inner layer 24 is approximately not more than 5.75 mm, and more preferably approximately not more than 4.0 mm. A thickness of the inner layer 24 that is less than approximately 0.75 mm will lessen the effect which the smash factor of the inner layer 24 has on the smash factor of the putter head. The thicker the inner layer 24, the greater the effect which the smash factor of the inner layer 24 has on the smash factor of the putter head. However, when the thickness of the inner layer 24 exceeds approximately 5.75 mm, the effect of the thickness stops changing.

Preferably, the thickness of the face insert 20 obtained by joining the outer layer 22 and inner layer 24 together is approximately at least 1 mm, and more preferably approximately at least 2 mm. Preferably, the thickness of the face insert 20 is approximately not more than 6 mm, and more preferably approximately not more than 5 mm. When the thickness of the face insert 20 is less than approximately 1 mm, material characteristics of the head body on the rear side of the face insert will have a great effect on the hitting feel. On the other hand, from a design viewpoint, when the thickness of the face insert 20 exceeds approximately 6 mm, the putter head will be too large, impairing its functions.

Regarding the method for joining the outer layer 22 and inner layer 24 of the face insert 20, it is preferable to join the outer layer 22 and inner layer 24 by fitting them together in order to eliminate the effect of an adhesive in designing the smash factor. According to the present embodiment, as shown in FIG. 5, the outer layer 22 of the face insert 20 has a loop-shaped protrusion 22*a* located on an outer edge of the outer layer 22 and extending to an inner side of the putter head. To allow the protrusion 22*a* to fit thereinto, the inner layer 24 has its outer edge shortened accordingly. Also, the outer layer 22 has cylindrical protrusions 22*b* near its outer edge, extending to the inner side of the putter head. To accept the protrusions 22*b*, the inner layer 24 has a circular hole at a location corresponding to the protrusions 22*b*.

The protrusions 22*a* and 22*b* cannot be formed in a central area of the face insert. Since the central area of the face insert is normally used to hit the golf ball during putting, any protrusion installed in the central area would greatly reduce the capability of the second polymer of the inner layer 24 to increase or decrease the smash factor of the putter head. That is, it is preferable that each of the outer layer 22 and inner layer 24 have a uniform thickness at least in the central area of the face insert 20. The central area as referred to herein is the middle area when the face insert 20 is divided into three equal areas in its width direction (toe-to-heel direction).

Figure 3:
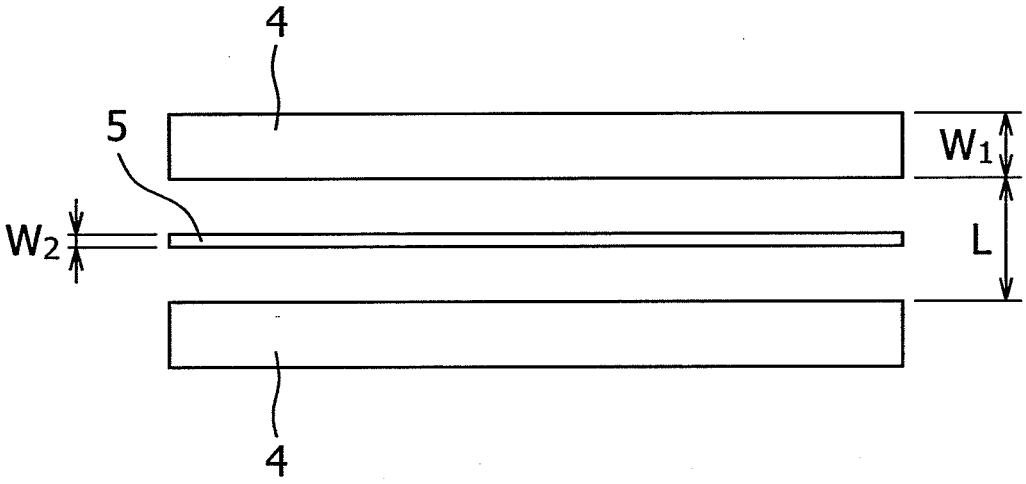
FIG. 3 is an enlarged view of the face insert shown in FIG. 2.
Figure 4A:
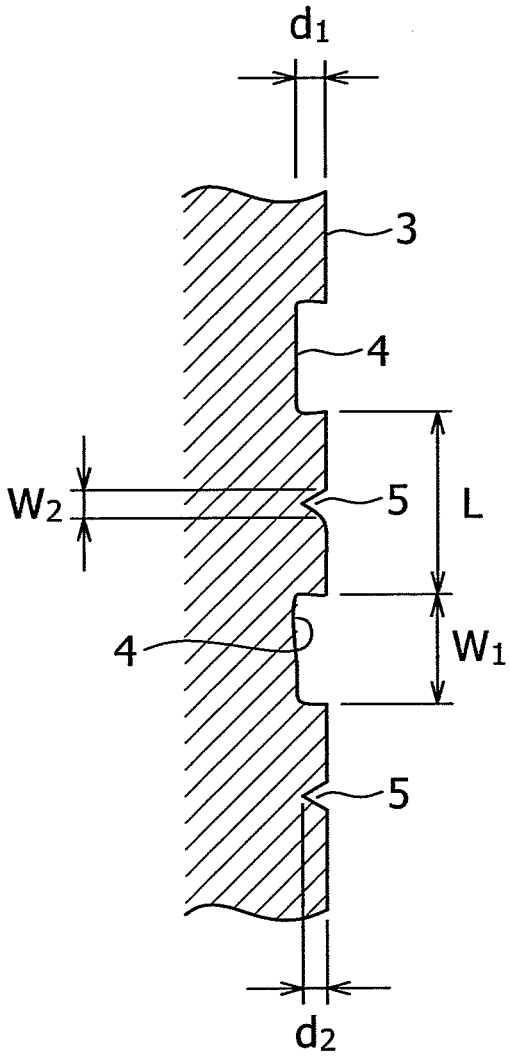
FIG. 4A is a sectional view of the face insert on the front side, taken along line A-A in FIG. 2.

As shown in FIG. 2, the two types of grooves, i.e., grooves 4 of a first groove group and grooves 5 of a second groove group, are formed in the external surface of the outer layer 22 of the face insert 20, i.e., in the face surface 3. As shown in FIGS. 3 and 4A, preferably the grooves 4 of the first groove group have a width $W_1$ of approximately 0.25 to 1.6 mm, more preferably approximately 0.5 to 1.25 mm, and most preferably approximately 0.6 to 1.25 mm. Preferably the grooves 5 of the second groove group have a width $W_2$ of approximately 0.075 to 0.5 mm, more preferably approximately 0.1 to 0.5 mm, and most preferably approximately 0.35 to 0.45 mm. The grooves 4 of the first groove group have a greater width than the grooves 5 of the second groove group.

Groove spacing L between two adjacent grooves 4 of the first groove group can be approximately 0.5 to 2.0 mm, more preferably approximately 0.8 to 1.5 mm. One or more grooves 5 of the second groove group are placed between the grooves 4 of the first groove group. The grooves 4 of the first groove group have a depth $d_1$ of approximately 0.05 to 0.5 mm, and more preferably approximately 0.25 to 0.5 mm. The grooves 5 of the second groove group have a depth $d_2$ of approximately 0.025 to 0.1 mm, and more preferably approximately 0.05 to 0.1 mm. The grooves 4 of the first groove group have a greater depth than the grooves 5 of the second groove group.

Figure 4B:
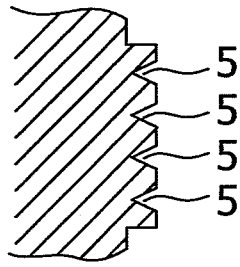
FIG. 4B is a sectional view showing another example of a face insert on the front side.

In this way, when the grooves 4 of the first groove group having a large width $W_1$ are arranged at predetermined groove spacing L and at least one groove 5 of the second groove group having a small width $W_2$ is placed between each pair of adjacent grooves 4 of the first groove group, since the amount of backspin imparted to a putted ball becomes small, the ball starts rolling over the green with overspin at an early stage after leaving the face surface, and consequently rolls smoothly along the line aimed at. In particular, even when the golfer putts against the grain of grass, the above configuration prevents a situation in which the ball does not carry as expected and the putt comes up very short (the ball stops far short of a cup). Incidentally, if only wider grooves 4 of the first groove group are arranged at narrower groove spacing without forming narrow grooves 5 of the second groove group, the contact area with the ball will be reduced greatly. Consequently, reduction in the initial ball speed will have a greater effect than reduction in the amount of backspin, causing the ball to roll poorly as a whole. As shown in FIG. 4B, multiple grooves 5 (e.g., three or four grooves) of the second groove group can be placed between each pair of adjacent grooves 4 of the first groove group. There can be a flat face surface 3 between each pair of adjacent grooves 5 of the second groove group.

Figure 6:
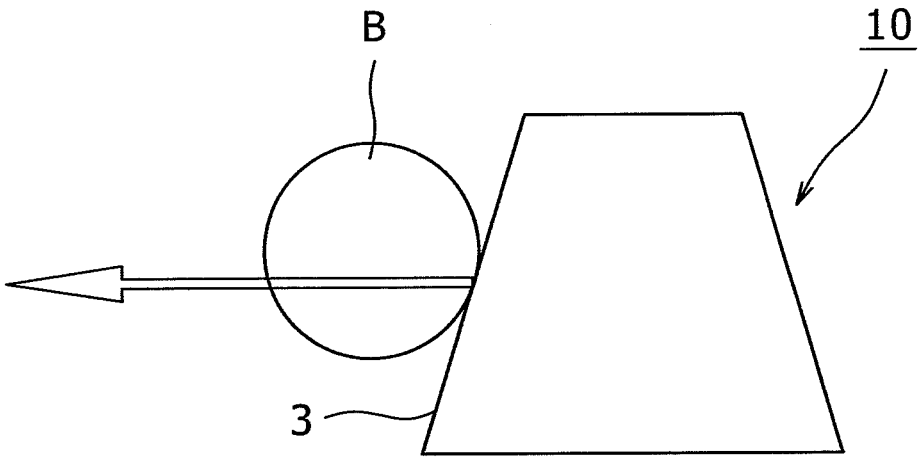
FIG. 6 is a schematic view showing a putter head driving off a ball with backspin.
Figure 7:
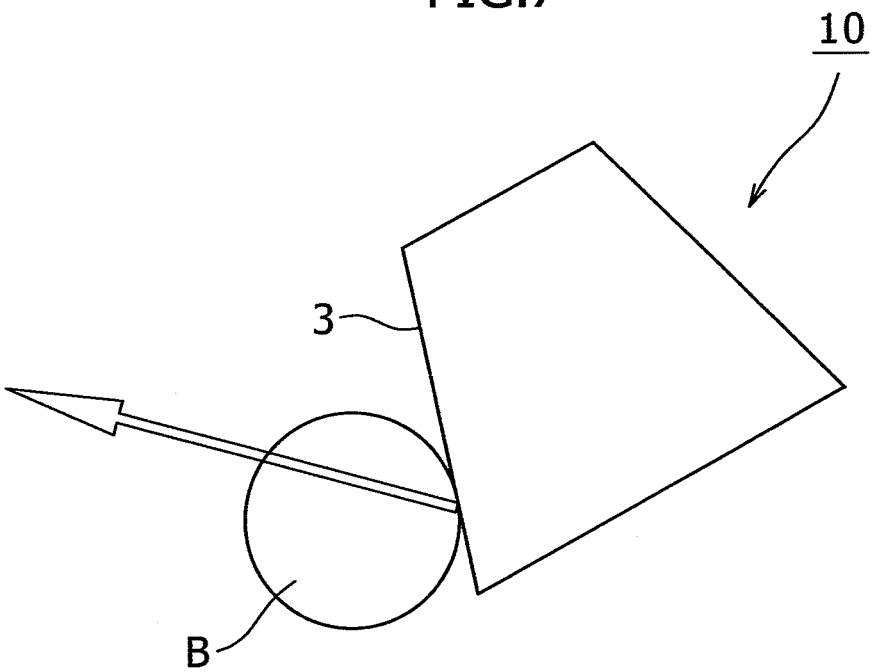
FIG. 7 is a schematic view showing a putter head driving off a ball with forward spin.

FIG. 6 is a schematic view showing movement of the putter head 10 driving off a ball B with backspin. As shown in FIG. 6, when initial spin is backspin, the contact area between the ball B and face surface 3 is reduced due to the existence of the grooves, reducing the amount of backspin. FIG. 7 is a schematic view showing movement of the putter head 10 driving off the ball B with forward spin. When the golfer drives off the ball B by scraping it up as shown in FIG. 7, the initial spin is forward spin. In that case, the wide grooves of the first groove group act to hook the ball B, increasing the amount of forward spin.

The reason the width $W_1$ of the grooves 4 of the first groove group is set to approximately 0.5 mm or more is that if the width $W_1$ is less than 0.5 mm, it is difficult to impart spin to the ball even if the golfer hits the ball by scraping it up in an attempt to impart forward spin to the ball. On the other hand, the reason the width $W_1$ of the grooves 4 of the first groove group is set to approximately not more than 1.52 mm is to comply with rules.

Preferably the grooves 5 of the second groove group placed between the grooves 4 of the first groove group are uniform in width, number, and spacing. This configuration makes it possible to provide the effect of the groove groups according to the present invention equally even if a ball-hitting point shifts up or down on the face surface. Also, preferably the grooves 4 and 5 of the first groove group and second groove group are arranged horizontally. This configuration makes it possible to provide the effect of the groove groups according to the present invention equally even if the ball-hitting point shifts left or right on the face surface.

Figure 8:
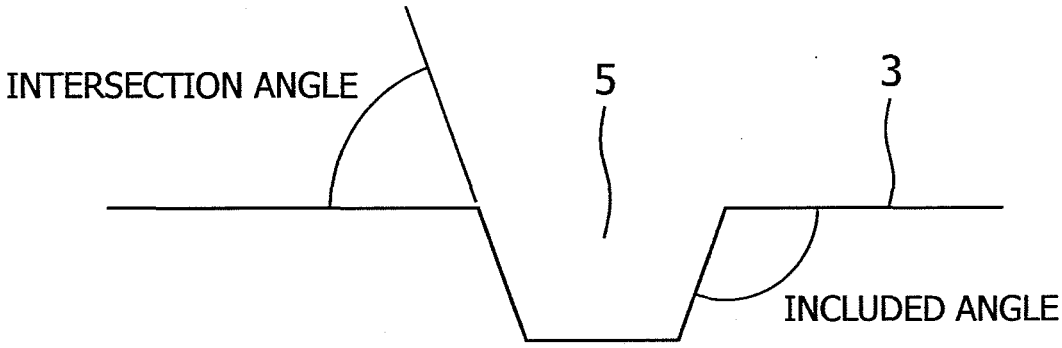
FIG. 8 is a schematic view showing an intersection angle and included angle between a face surface and groove surface.
Figure 9:
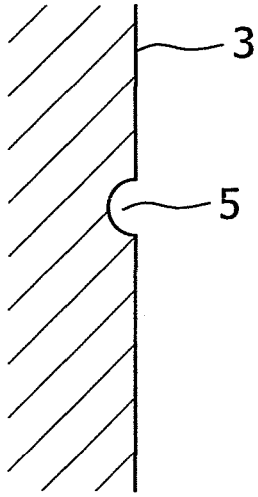
FIG. 9 is a sectional view showing another example of a groove of a second groove group.
Figure 10:
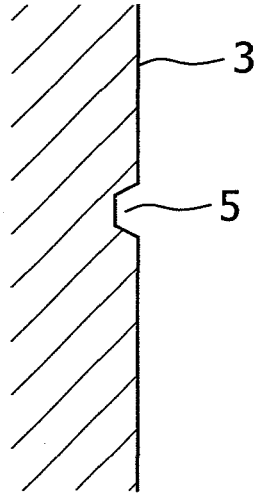
FIG. 10 is a sectional view showing still another example of a groove of the second groove group.

As shown in FIG. 4A, the grooves 4 of the first groove group are rectangular grooves, and thus an intersection angle between the face surface 3 and sides of the grooves 4 is a right angle or almost a right angle, making it easy to increase the amount of forward spin on the ball. On the other hand, the grooves 5 of the second groove group are triangular grooves, and thus have a smaller intersection angle between the face surface 3 and sides of the grooves 5 than the rectangular grooves. In other words, the grooves 5 have a larger included angle, i.e., an angle formed by the face surface 3 and sides of the grooves 5, making it difficult to increase the amount of forward spin on the ball. The intersection angle and included angle are shown in FIG. 8. In this way, it is preferable that the grooves 5 of the second groove group have a smaller intersection angle and larger included angle than the grooves 4 of the first groove group. This makes it possible to increase the amount of forward spin using the grooves 4 of the first groove group which have angles close to right angles while minimizing reduction in the contact area between the ball and face surface. Besides the triangular grooves, the grooves 5 of the second groove group may also be configured to be, for example, semicircular grooves as shown in FIG. 9, or trapezoidal grooves as shown in FIG. 10, to decrease the intersection angle and increase the included angle.

It is also possible to increase the amount of forward spin while minimizing reduction in the contact area between the ball and face surface by varying only the intersection angle between the grooves 4 of the first groove group and the grooves 5 of the second groove group. Regarding the grooves 5 of the second groove group, the tip of the included angle may be rounded. As for the grooves 4 of the first groove group, preferably the tip of the included angle is kept sharp.

Although according to the present embodiment, the face insert has a two-layer structure, the present invention is not limited to this, and the face insert may have a multilayer structure made up of three or more layers. For example, one or more additional layers may be provided between the inner layer 24 and head body 12. The hardness and smash factor of the additional layers are not particularly limited, but preferably they are set between those of the outer layer and inner layer.

The shape of the face insert 20 is not limited to the trapezoid shown in FIGS. 1, 2, and the like. The face insert 20 may have a rectangular, pentagonal, hexagonal, or other polygonal shape. However, preferably the face surface of the face insert 20 is flat.

Although according to the present embodiment, the protrusions 22*a* and 22*b* are formed on the outer layer 22 and the groove and holes are formed in the inner layer 24 to fit the protrusions, the present invention is not limited to this and protrusions may be formed on the inner layer, and a groove and holes may be formed in the outer layer to fit the protrusions.

Also, although loop-shaped or cylindrical protrusions are shown in FIG. 5, the shape of the protrusions are not limited to this. For example, the protrusions may have any shape such as a cylinder, hollow cylinder, cone, polygonal prism, polygonal tube, or polyhedral pyramid. Also, the number of protrusions is not limited, and one or more protrusions may be formed. Also, the protrusions may have any height. For example, the height of the protrusions on the outer layer may be set equal to or less than the thickness of the inner layer. Also, all the protrusions may have an equal height or different heights.

Available materials for the head body 12 include, but are not limited to, stainless steel, aluminum, aluminum alloy, brass, copper, titanium alloy, zinc, and carbon fiber reinforced resin.

EXAMPLES

First, face inserts of a single-layer structure were constructed using six types of polymer with different D hardness values (Examples 1 to 6). Putter heads were constructed by mounting the face inserts in head bodies, and then putters were constructed using the putter heads. The face inserts measured 20 mm high, 50 mm wide, and 4 mm thick and weighed 4 g. The head bodies were made of aluminum alloy. The putter heads weighed 340 g each. Shafts were made of steel, and clubs weighed 505 g each.

In Table 1, "Polyurethane" indicates a thermoplastic polyurethane elastomer, "Polyamide" indicates a thermoplastic polyamide elastomer, and "Polyester" indicates a thermoplastic polyester elastomer.

TABLE 1

| | Polymer name | D hardness | Initial speed (m/s) | Smash factor |
|---|---|---|---|---|
| Example 1 | Polyurethane A | 63.5 | 2.740 | 1.522 |
| Example 2 | Polyurethane B | 40.8 | 2.734 | 1.519 |
| Example 3 | Polyurethane C | 52.2 | 2.730 | 1.517 |
| Example 4 | Polyamide A | 58.5 | 2.783 | 1.546 |
| Example 5 | Polyamide B | 39.8 | 2.750 | 1.528 |
| Example 6 | Polyester | 35.6 | 2.785 | 1.547 |

Figure 11:
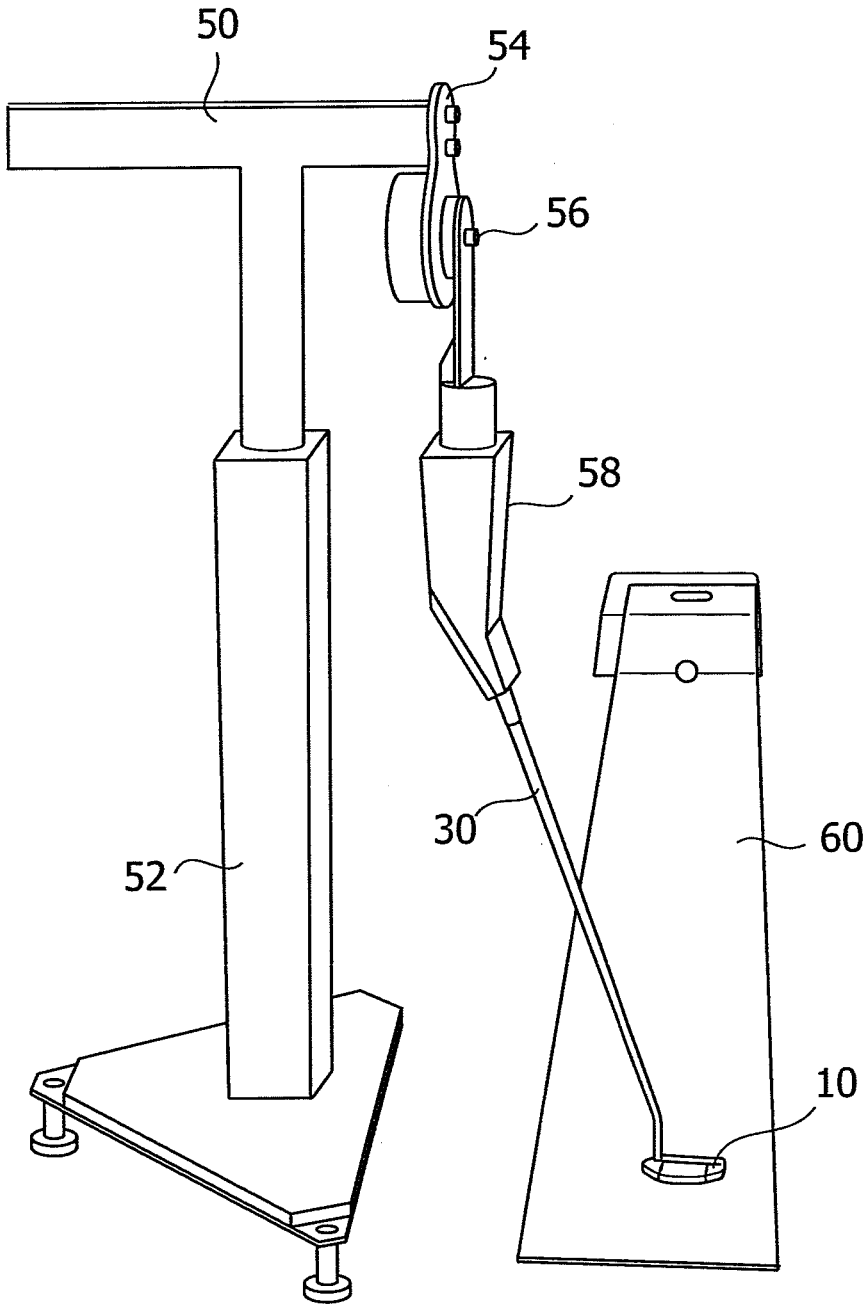
FIG. 11 is perspective view of pendulum robot used for putting tests of putter heads.

Then, by putting with the constructed putters, initial ball speed was measured. A pendulum robot 50 shown in FIG. 11 was used for the putting. An arm 54 hung down from a body 52 of the pendulum robot 50 and a putter 30 was griped by a hand 58 at an end of the arm. A movable part 56 which rotates along a vertical plane is attached to the arm, and the arm below the movable part swings the putter 30 as the movable part 56 rotates.

Using a high-speed CCD camera (not shown), initial ball speed and head speed were calculated from travel distance of the ball or head by computer-based image processing. Specifically, 250 shots per second were taken with the CCD camera and measurements were taken using an image in each shot. To measure the travel distance of the ball, a computer was made to learn distance and horizontal direction in camera images with reference to a bar (not shown) placed in a direction in which the ball rolls. Then, the head speed was measured based on four shots immediately preceding a putter head impact. To calculate the initial ball speed, the center of the ball was determined by image processing based on five shots following the impact (after the ball leaves the face surface). The initial ball speed was measured on green sheet 60 (MG-14 manufactured by ProGreen International, Inc.) and the golf ball used was TourStage X-01R[4] manufactured by Bridgestone Sports Co., Ltd. The head speed during putting was 1.80 m/s under all conditions. Results of the testing are shown in Table 1.

Next, four types of face insert with a two-layer structure shown in Table 2 were constructed (Examples 7 to 10) by combining six types of polymer which have D hardness and meet factor values shown Table 1. Then, by putting with putters constructed using the face inserts, initial ball speed was measured in the same manner as described above. The outer layers of the face inserts were 2 mm thick and the inner layers were 2 mm thick. As shown in FIG. 2, the outer layer and inner layer were joined using a 2-mm-high, 1-mm-wide, loop-shaped protrusion formed on the outer edge of the outer layer and 3-mm-diameter, cylindrical protrusions formed 5 mm inside the loop-shaped protrusion. Otherwise, design conditions of the putter and measurement conditions of the initial ball speed were the same as in Examples 1-6. Results of the testing are shown in Table 2.

TABLE 2

| | Outer layer | Inner layer | Initial speed (m/s) | Smash factor |
|---|---|---|---|---|
| Example 1 | Polyurethane A | Polyester | 2.763 | 1.535 |
| Example 2 | Polyamide A | Polyamide B | 2.767 | 1.537 |
| Example 3 | Polyurethane B | Polyamide A | 2.752 | 1.529 |
| Example 4 | Polyester | Polyurethane C | 2.758 | 1.532 |

As shown in Table 2, with the putters of Examples 7 and 9 in which the inner layer had a larger smash factor than the outer layer, it was possible to obtain a smash factor larger than that of the outer layer. On the other hand, with the putters of Examples 8 and 10 in which the inner layer had a smaller smash factor than the outer layer, it was possible to obtain a smash factor smaller than that of the outer layer. In this way, it was found that the use of a two-layer structure made up of an outer layer and inner layer makes it possible to design the smash factor of the putter head based on the smash factors of the outer layer and inner layer of the face insert.

In addition, face inserts of a single-layer structure (Examples 11 and 12) and face inserts of a two-layer structure (Examples 13 and 14) were constructed using two different types of thermoplastic polyurethane elastomer with D hardness of 36.6 and 67.7. Then, an advanced golfer was asked to actually hit a ball with putters constructed using the face inserts and evaluate the hitting feel.

The putter of Example 11, i.e., the putter of a single-layer structure constructed using polyurethane with high D hardness received a rating of a hard hitting feel. The putter of Example 12, i.e., the putter of a single-layer structure constructed using polyurethane with low D hardness received a rating of a soft hitting feel. On the other hand, the putter of Example 13, i.e., the putter of a two-layer structure made up of an outer layer constructed using polyurethane with high D hardness and an inner layer constructed using polyurethane with low D hardness received a rating of a hitting feel a little softer than the putter of Example 11. The putter of Example 14, i.e., the putter of a two-layer structure made up of an outer layer constructed using polyurethane with low D hardness and inner layer constructed using polyurethane with high D hardness received a rating of a hitting feel a little harder than the putter of Example 12. When the putters of Examples 13 and 14 were compared, the putter of Example 13 received a rating of a hard hitting feel closer to that of Example 11. Thus, it was found that the hitting feel of putter which uses a face insert of a two-layer structure is affected greatly by the D hardness of the outer layer.

Results of the testing show that when a face insert of a two-layer structure is used, the D hardness of the outer layer which comes into direct contact with the golf ball has a large effect on the hitting feel experienced by the golfer regardless of the D hardness of the inner layer which does not come into direct contact with the golf ball and that the smash factor of a two-layer structure can be increased and decreased by using not only the smash factor of the outer layer, but also the smash factor of the inner layer.

Also, a face insert was constructed by setting the groove spacing L between each pair of the adjacent grooves of the first groove group to 1.1 mm and placing one groove of the second groove group in the middle of the groove spacing L. The grooves 4 of the first groove group had a width $W_1$ of 0.7 mm and a depth $d_1$ of 0.4 mm. The grooves 5 of the second groove group had a width $W_2$ of 0.39 mm and a depth $d_2$ of 0.075 mm. Cross-sectional shape of the grooves of the first groove group was rectangular and cross-sectional shape of the grooves of the second groove group was triangular (V-groove). Thus, distance between the grooves of the first groove group and grooves of the second groove group was reduced by at least half.

Two types of putter, a first putter and second putter, were prepared: the first putter was constructed using a face insert on which the wide grooves of the first groove group and narrow grooves of the second groove group were formed in combination and the second putter was constructed using a face insert on which only grooves of the first groove group were formed at groove spacing of approximately 0.5 mm. Testing was conducted to compare the two types of putter using ten amateur golfers. As a result, eight out of ten golfers felt that the ball rolled better when the first putter was used than when the second putter was used. All the golfers actually experienced a soft hitting feel.

What is claimed is:

1. A putter head, comprising:

a head body having a face having a recess formed in a central area of the face; and a face insert fitted in the recess, the face insert being made of polymer materials, the face insert having a multilayer structure made up of an outer layer having a ball-hitting surface that is exposed outside the putter head and an inner layer located on an inner side of the head body, wherein a first smash factor of a first polymer material forming the outer layer is lower than a second smash factor of a second polymer material forming the inner layer, wherein a groove group made up of a plurality of parallel grooves is formed in an external surface of the outer layer, the groove group including a first groove group and a second groove group of different types, wherein the grooves of the first groove group are approximately 0.25 to 1.6 mm wide and approximately 0.05 to 0.5 mm deep and the grooves of the second groove group are approximately 0.075 to 0.5 mm wide and approximately 0.025 to 0.1 mm deep, the first groove group has a groove spacing of approximately 0.5 to 2.0 mm, and the grooves of the second groove group are placed between the grooves of the first groove group, wherein the grooves of the first and second groove groups are empty.

2. The putter head according to claim 1, wherein a first hardness of the first polymer material is less than a second hardness of the second polymer material.

3. The putter head according to claim 1, wherein each of the inner layer and the outer layer has a uniform thickness at least in a central area of the face insert.

4. The putter head according to claim 1, wherein a protrusion is formed on an internal surface of the outer layer and a groove or hole is formed in an external surface of the inner layer to fit over the protrusion; and wherein the outer layer and the inner layer are joined together by a fit between the protrusion and the groove or hole.

5. The putter head according to claim 1, wherein an angle formed between a face surface of the face insert and sides of the grooves of the second groove group is greater than an angle formed between the face surface of the face insert and sides of the grooves of the first groove group.

6. The putter head according to claim 1, wherein an intersection angle between the face surface of the face insert and sides of the grooves of the first groove group is unequal to an intersection angle between the face surface of the face insert and sides of the grooves of the second groove group.

7. The putter head according to claim 1, wherein the grooves of the first groove group are approximately 0.5 to 1.52 mm wide and approximately 0.25 to 0.5 mm deep and the grooves of the second groove group are approximately 0.1 to 0.5 mm wide and approximately 0.05 to 0.1 mm deep.

8. The putter head according to claim 1, wherein the putter head has a loft angle of approximately 2 to 5 degrees.

* * * * *